US005475937A

United States Patent [19]

Korsen

[11] Patent Number: 5,475,937

[45] Date of Patent: Dec. 19, 1995

[54] SHOE SPIKE APPARATUS

[76] Inventor: David L. Korsen, 1203 Lawndale Dr., Twin Falls, Id. 83301

[21] Appl. No.: 249,270

[22] Filed: May 25, 1994

[51] Int. Cl.[6] ..... A43C 15/02; A43C 15/16

[52] U.S. Cl. ..... 36/134; 36/67 D

[58] Field of Search ..... 36/134, 59 R, 36/67 D, 62, 64, 36 B, 36 C, 42, 67 R

[56] References Cited

U.S. PATENT DOCUMENTS

| | | | |
|---|---|---|---|
| 1,366,518 | 1/1921 | Buchman | 36/36 B |
| 2,607,134 | 8/1952 | Langer | 36/59 |
| 2,608,007 | 8/1952 | Shapiro | 36/2.5 |
| 3,351,967 | 11/1967 | Dardig | 36/36 B |
| 3,403,461 | 10/1968 | McCarney | 36/67 |
| 3,478,447 | 11/1969 | Gillead | 36/36 B |
| 3,566,489 | 3/1971 | Morley | 36/67 |
| 4,035,934 | 7/1977 | Hrivnak | 36/67 D |
| 4,240,215 | 12/1980 | Broussard | 36/67 D |
| 4,262,434 | 4/1981 | Michelotti | 36/67 D |
| 4,318,232 | 3/1982 | Ching | 36/73 |
| 4,380,878 | 4/1983 | Skaja | 36/67 D |
| 4,414,763 | 11/1983 | Bente | 36/134 |
| 4,445,288 | 5/1984 | Frör | 36/134 |
| 4,492,047 | 1/1985 | Arff | 36/134 |
| 4,633,600 | 1/1987 | Dassler et al. | 36/134 |
| 4,644,672 | 2/1987 | Dassler et al. | 36/134 |
| 4,648,187 | 3/1987 | Dassler et al. | 36/134 |
| 4,698,923 | 10/1987 | Arff | 36/128 |
| 4,706,394 | 11/1987 | Regula | 36/67 D |
| 4,875,300 | 10/1989 | Kazz | 36/134 |
| 5,027,532 | 7/1991 | MacNeill et al. | 36/134 |
| 5,123,184 | 6/1992 | Ferreira | 36/134 |

FOREIGN PATENT DOCUMENTS

| | | |
|---|---|---|
| 2260084 | 6/1974 | Germany . |
| 320029 | 10/1929 | United Kingdom . |

*Primary Examiner*—Steven N. Meyers
*Assistant Examiner*—Ted Kavanaugh
*Attorney, Agent, or Firm*—John E. Benoit

[57] ABSTRACT

Shoe spike apparatus permitting quick interchange or replacement of gripping elements, the apparatus including a shoe sole attachment plate with a downwardly depending stabilizer shaft; a snap ring socket affixed to the plate; a snap ring received within the socket; and a spike member provided with a recess for receiving the stabilizer shaft and a groove for receiving the snap ring to hold the spike member firmly and without lateral movement to the attachment plate and shaft. Circular construction of engaging surfaces of the spike member and the socket and snap ring allow rotational movement of the spike member relative to the socket to prevent rotational stress which might otherwise tear the sole attachment plate from the sole in which it is embedded. Rigid contact surfaces permit only uni-directional removal of the spike member from the socket for assuring the integrity of the snap lock mechanism. An annular shoulder may be provided on the spike member for convenient removal by any edged tool of the proper dimension.

13 Claims, 1 Drawing Sheet

1
10
50
50
21
29
2
20
2
22
30
32
41
34
40
51
53
10
54
58
52
50
57

30
20
2
22
21
32
151
153
34
40
154
152
1
158
157
150

30
2
21
29
51
20
1
32
53
34
54
40
58
22
52
10
50
57

21
22
32
20
10
40
41
30
51
53
54
50
57

SHOE SPIKE APPARATUS

BACKGROUND OF THE INVENTION

1. Field of the Invention

This invention relates to spike apparatus for shoes and, more particularly, to interchangeable and readily removable and replaceable spikes for athletic shoes.

2. Description of the Prior Art

The desirability of cleats and spikes on shoes for superior traction has long been recognized, particularly in the athletic endeavors of runners, golfers, football players, soccer players, and the like. It is also highly desirable that individual spikes be readily removable and replaceable where the spike has become broken, deformed, or otherwise impaired and where other gripping elements are desired.

Typifying the present art in an attempt to provide such spikes or cleats are the two patents of Dassler et al—U.S. Pat. Nos. 4,633,600 and 4,644,672, as well as the patent of A. Hrivnak, U.S. Pat. No. 4,035,934. Dassler utilizes an elastic annular rib in a snap-lock arrangement and a screw-on type element to hold the gripping members to a shoe stud. The Hrivnak device utilizes a pair of spring members having shoulders which lock into a flange on the spike member to hold the spike in place. Problems in the prior art include the loss of spikes which are screwed into place or constructed of elastic material; damage to the supporting sole where rotational stress is placed upon a non-rotatable spike; complicated and expensive spike retention members; time required to interchange spikes; and lateral movement of the spike members within sockets or studs, also causing loss for damage.

SUMMARY OF THE INVENTION

The shoe spike apparatus of the present invention overcomes the problems of the prior art in providing a shoe attachment means provided with a snap ring socket and a stabilizer shaft perpendicularly depending from the attachment means and a spike member having a groove for retaining a snap ring for locking the spike member to the socket. The circular rigid shaft is received within a mating opening in the spike member to prevent any lateral movement between the spike member and the socket and yet permit rotational movement of the spike member within the socket to eliminate rotational stress on the attachment means engagement with the sole of the shoe. Such construction allows removal of the spike member from the socket in a unidirectional manner to assure the locking integrity of the snap ring. All engagement members, other than the snap ring, are inflexible for precision fit. Additional objects and advantages will become apparent and a more thorough and comprehensive understanding may be had from the following description taken in conjunction with the accompanying drawings forming a part of this specification.

DETAILED DESCRIPTION OF THE INVENTION

Figures 1, 2, 3, 4, 5:
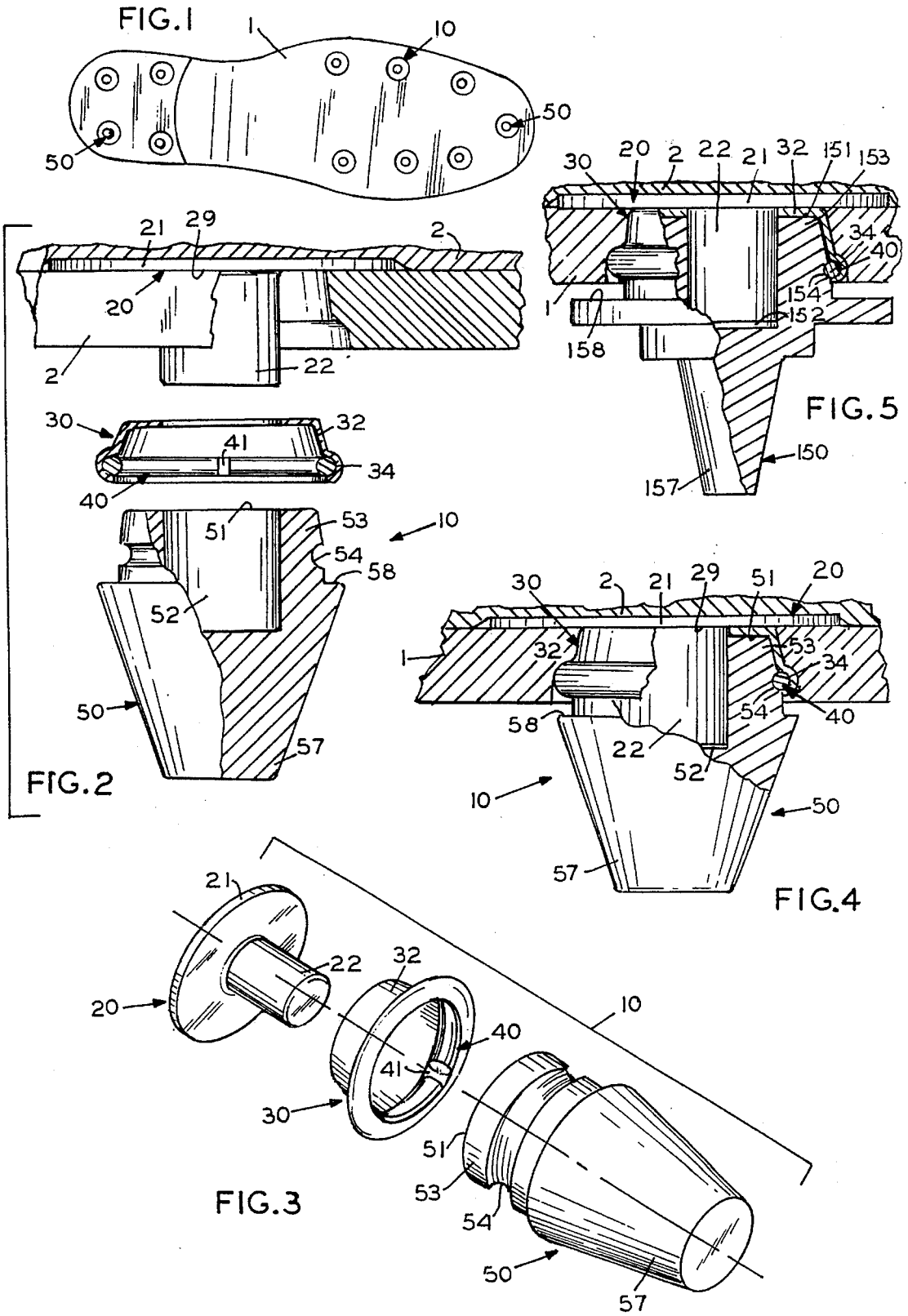
FIG. 1 is a plan view of a shoe sole showing the shoe spike members of the present invention installed.
FIG. 2 is an exploded side view, in partial section, of the invention as attachable to a shoe sole.
FIG. 3 is a perspective exploded view of the device of the present invention, in partial section.
FIG. 4 is a side view with all structural elements in place for use.
FIG. 5 is a side view of a second embodiment of the invention.

Referring now to the drawings, FIGS. 1–4, a first embodiment to be preferred of shoe spike apparatus 10, made according to the present invention, is disclosed. Shoe spike apparatus 10 includes, generally, shoe attachment means, designated by the numeral 20; a snap ring socket 30; a snap ring 40; and a spike member 50.

Shoe attachment means 20 includes an anchor plate 21, made of rigid material, preferably of metal such as stainless steel. The anchor plate includes planar opposing surfaces and may be circular in form, as shown in FIG. 3. The anchor plate is embedded in the outer sole 1 of the shoe or between the outer sole and the shoe base 2. Plate 21 is provided with a downwardly depending stabilizer shaft 22, constructed also of rigid material, such as stainless steel. Shaft 22 is perpendicularly affixed to plate 21 as by welding, screws, or by other conventional fasteners, or may be integral with the plate. The shaft may be either hollow or solid, solid being preferred, and is circular in cross section for reasons hereinafter stated.

Also affixed to the anchor plate, as by welding or otherwise, is a rigid snap ring socket 30, also constructed of metal. Socket 30 is tabular in shape having a cylindrical wall 32 which is coaxially spaced relative to stabilizer shaft 22. Wall 32 defines on its inner surface an annular groove 34 for receiving snap ring 40. Snap ring 40 is constructed of flexible steel, circular in cross-section, and defines an expansion-contraction gap 41 as is conventional with snap rings.

Spike member 50 is provided with a base portion 53 and a gripping portion 57. The base portion may be integral with the gripping portion or the gripping portion may be constructed of a different material than the base portion, depending upon the gripping characteristics required. Where construction is of a material differing in composition from the base portion, the gripping portion may be affixed to the base portion by any suitable means. It is essential to the invention that the base portion be constructed of a rigid material, stainless steel being preferred, because of its engagement with both snap ring 40 and stabilizer shaft 22.

Base portion 53 is circular in cross-section and contains on its exterior surface an annular groove 54 for receiving snap ring 40, contained within groove 34 of socket 30, to snap lock spike member 50 to the socket and hence shoe attachment means 20. The base portion also defines a recess or opening 52, perpendicular to a planar end surface 51, for snug reception of and engagement with shaft 22 of shoe attachment means 20. It is to be noted and appreciated that this circular construction allows complete and free rotation of spike member 50 within socket 30 to eliminate tearing of the anchor plate from the sole, which often results where rotation of the spike member is not possible. Planar end surface 51 of the spike member presents a surface for flush engagement with surface 29 of plate 21, cooperating in the rotational movement of the spike member.

Gripping portion 57 of spike member 50 may be of any suitable material and of any suitable length and shape; such dimensions being dependent upon designed use. The gripping portion is provided with tool engagement means for removal of spike member 50 from socket 30 and from shaft 22 of shoe attachment means 20. In the embodiment shown, the tool engagement means comprises a shoulder 58 extending about the peripheral base of the gripping portion of the spike. Any edged tool of suitable dimensions or a coin may be used to dislocate spike member 50 from the socket and snap ring. It is obvious that other tool engagement means may be provided, such as recesses, clamping areas, etc.

Referring now to FIG. 5, a second embodiment of the invention may be seen. Like numbers refer to the same structural elements as in the first embodiment. The primary difference in the second embodiment is in the spike member, designated by the numeral 150. Spike member 150 is provided with a base portion 153 and a gripping portion 157. As in the first embodiment, the base portion is provided with an annular groove 154 for receiving snap ring 40 and a recess 152 for receiving shaft 22 of shoe attachment means 20. Unlike the first embodiment, spike member 150 includes an expansive shoulder in the nature of an apron 158, serving to cover and act as a shield to protect the underlying snap ring socket 30 from entry of soil, grass, or other debris.

Again referring to the first embodiment, for installation of a spike member 50 into socket 30, the spike member is simply inserted into socket 30 with the opening 52 of the spike member receiving shaft 22 of shoe attachment means 20. A slight pressure on the spike gripping portion 57 causes the spike member to move into socket 30, with groove 54 of the spike member snapping into locking engagement with snap ring 40, held in groove 34 of socket 30. It will be noted that lateral movement is precluded between the spike member and the socket and that the only directional forces operable to remove the spike member are in a direction opposite to that of installation, ie., downward movement, perpendicular to anchor plate 21. It will also be noted, then, that the natural position of the shoe and weight of the user at all times tend to keep the shoe spike in place.

For removal of a spike member from socket 30, a coin, screw driver, or other edged tool is inserted between shoulder 58 of spike member 50 and the bottom surface of socket 30 and the spike member is then pried from its engagement with the snap ring and socket.

Having thus described in detail preferred embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Shoe spike apparatus comprising:

shoe attachment means adapted to be secured to a base of a shoe;

a downwardly depending stabilizer shaft secured to said shoe attachment means, said stabilizer shaft being substantially circular in cross-section;

a snap ring socket affixed to said shoe attachment means and extending about said stabilizer shaft; a snap ring receivable within said socket; and a spike member having a base portion and a gripping portion for gripping engagement with a foot support surface, said base portion defining substantially circular opening for receiving said stabilizer shaft and further defining a groove for receiving said snap ring for locking said spike member to said shoe attachment means, said base portion being rotatable about said stabilizer shaft when mated therewith.

2. The apparatus as described in claim 1 wherein said shoe attachment means comprises an anchor plate adapted to be affixed to a sole of a shoe and wherein said stabilizer shaft is affixed perpendicularly to said anchor plate.

3. The apparatus as described in claim 1 wherein said snap ring socket includes a cylindrical wall spaced from and coaxial with said stabilizer shaft for receiving said base portion of said spike member and said wall including an annular groove on an internal surface for receiving said snap ring.

4. The apparatus as described in claim 1 wherein said snap ring is circular in cross section.

5. The apparatus as described in claim 1 wherein said spike member includes tool engagement means for axial withdraw of said spike member from said socket.

6. The apparatus as described in claim 5 wherein said tool engagement means comprises an annular shoulder about the periphery of said spike member.

7. The apparatus as described in claim 1 wherein said shaft, said socket and said spike member are comprised of rigid material.

8. Shoe spike apparatus comprising:

shoe sole attachment means adapted to be secured to a sole of a shoe including a horizontally oriented anchor plate and a stabilizer shaft affixed to and downwardly and substantially perpendicularly depending from said anchor plate, said stabilizer shaft being substantially circular in cross-section;

a snap ring socket affixed to said shoe sole attachment means, said socket including a cylindrical wall spaced from and coaxial with said stabilizer shaft, said wall defining on an interior surface an annular groove a snap ring receivable within said annular groove of said socket; and a spike member including a base portion defining a substantially circular opening adapted to mate with said stabilizer shaft for engaging said stabilizer shaft to prevent lateral movement of said spike member relative to said shoe sole attachment means;

an annular groove on an exterior surface of said base portion for receiving said snap ring for locking said spike member to said socket and hence said shoe sole attachment means; said base portion being rotatable about said stabilizer shaft; and said spike member including a gripping portion for secure engagement with a footing surface when engaged therewith.

9. The apparatus as described in claim 8 wherein said spike member is provided with tool engagement means for axial withdraw of said spike member from said stabilizer shaft and from said socket.

10. The apparatus as described in claim 9 wherein said tool engagement means comprises an annular shoulder about the periphery of the base of said gripping portion of said spike member.

11. The apparatus as described in claim 8 wherein said anchor plate of said shoe sole attachment means includes a planar upper surface and wherein the base portion of said spike member defines a planar annular surface for flush engagement between said spike member and said anchor plate.

12. The apparatus as described in claim 8 wherein said anchor plate, said stabilizer shaft, said snap ring socket and the base portion of said spike member are constructed of rigid inelastic material to prevent lateral movement relative to one another.

13. Shoe spike apparatus comprising shoe attachment means adapted to be secured to the base of a shoe;

a downwardly depending stabilizer shaft secured to said shoe attachment means, said stabilizer shaft being substantially circular in cross-section;

a socket affixed to said shoe attachment means and extending about said stabilizer shaft;

substantially circular expandable spring means receiving said stabilizing shaft within said socket;

a spike member having a base portion and a gripping portion for engagement with a foot support surface;

a substantially circular opening in said base portion for receiving said stabilizer shaft, said base portion being rotatable about said stabilizer shaft when mated there with;

a circular groove about said base portion for receiving said spring means for locking said spike member to said shoe attachment means.

* * * * *